US008777656B2

(12) United States Patent
Kuo et al.

(10) Patent No.: US 8,777,656 B2
(45) Date of Patent: Jul. 15, 2014

(54) CONNECTOR MECHANISM FOR SECURING A PLUG TO A CASING

(71) Applicant: Wistron Corporation, New Taipei (TW)

(72) Inventors: Wei-Ching Kuo, New Taipei (TW); Ting-Fang Lai, New Taipei (TW); Chuan-Hsiao Chiu, New Taipei (TW)

(73) Assignee: Wistron Corporation, Hsichih, New Taipei (TW)

( * ) Notice: Subject to any disclaimer, the term of this patent is extended or adjusted under 35 U.S.C. 154(b) by 9 days.

(21) Appl. No.: 13/792,247

(22) Filed: Mar. 11, 2013

(65) Prior Publication Data

US 2013/0260581 A1 Oct. 3, 2013

(30) Foreign Application Priority Data

Apr. 3, 2012 (TW) ..... 101206041 U

(51) Int. Cl.

| | |
|---|---|
| ***H01R 13/62*** | (2006.01) |
| ***H01R 13/447*** | (2006.01) |
| ***H01R 13/627*** | (2006.01) |
| *H01R 24/64* | (2011.01) |

(52) U.S. Cl.

CPC ..... *H01R 13/627* (2013.01); *H01R 24/64* (2013.01); *H01R 13/447* (2013.01); *H01R 2201/04* (2013.01); *H01R 2201/06* (2013.01); *H01R 13/6272* (2013.01)

USPC ..... 439/372

(58) Field of Classification Search

CPC ..... H01R 13/447; H01R 13/639; H01R 13/5213; H01R 13/6275; H01R 13/6392; H01R 13/6395

See application file for complete search history.

(56) References Cited

U.S. PATENT DOCUMENTS

| | | | | |
|---|---|---|---|---|
| 6,220,899 | B1 * | 4/2001 | Suzuki | 439/675 |
| 7,704,085 | B1 * | 4/2010 | Chang | 439/137 |
| 8,025,514 | B1 * | 9/2011 | Wang | 439/172 |
| 8,038,456 | B1 * | 10/2011 | Wang | 439/172 |
| 8,500,481 | B2 * | 8/2013 | Lin et al. | 439/372 |
| 2013/0034985 | A1 * | 2/2013 | Lin et al. | 439/347 |
| 2013/0059454 | A1 * | 3/2013 | Cheng et al. | 439/135 |
| 2013/0072042 | A1 * | 3/2013 | Liao | 439/142 |
| 2013/0130524 | A1 * | 5/2013 | Wang | 439/142 |
| 2013/0231010 | A1 * | 9/2013 | Liang et al. | 439/676 |

* cited by examiner

*Primary Examiner* — Chandrika Prasad
(74) *Attorney, Agent, or Firm* — Winston Hsu; Scott Margo

(57) ABSTRACT

A connector mechanism includes a casing, a socket, a rotary cover and a resilient plate. An opening is formed on the casing. The resilient plate is connected to an inner side of the casing and the rotary cover for driving the rotary cover to rotate relative to the casing. The resilient plate includes a fixing portion fixed on the inner side of the casing, a driving portion resiliently connected to the fixing portion and the rotary cover for driving the rotary cover to rotate relative to the casing by deflection relative to the fixing portion, and a stopping portion disposed on the driving portion for stopping a tongue of a plug as the plug passes through the opening to connect with the socket, so as to fasten the plug.

14 Claims, 7 Drawing Sheets

CONNECTOR MECHANISM FOR SECURING A PLUG TO A CASING

BACKGROUND OF THE INVENTION

1. Field of the Invention

The present invention relates to a connector mechanism for connecting a plug, and more particularly, to a connector mechanism with a rotary cover driven by a resilient plate for fastening a plug.

2. Description of the Prior Art

With the development of information and computer technology, the size of a computer is becoming smaller and the computer is utilized in a wide variety of fields. In order to expand functions of a computer system for satisfying a user's various demands, various external devices of the computer system come with the trend. For example, an external hard disk drive and a portable storage device can expand the memory capacity of the computer system. An external optical disk drive and an optical disk writer can expand multimedia access function of the computer system. A network cable allows the computer system to be connected to an internet so as to gather information online or surf webpage. However, because of the thinning size of the notebook computer, it brings more challenges for mechanical design. Connecting ports disposed on a side of the notebook computer will constrain the thickness of mechanism of the notebook computer. For example, an Ethernet port (such as a RJ 45 port) for connecting to network or a RJ11 port for connecting a telephone cable has a fixed size of the opening. So, the notebook computer needs to increase its thickness in order to match the size of the connecting ports. Alternatively, the network port or the telephone port is exposed out of the notebook computer so as to affect an aesthetic feeling of appearance. For improving the above-mentioned drawbacks, US patent publication no. 2010/0248554 discloses a mechanical design with a rotary cover to adjust a size of an opening. However, it utilizes a spring sheathed on a shaft of the rotary cover to rotate the rotary cover, so that the shaft may be broken easily by shearing force. Furthermore, the fixing structure for fixing a connector is disposed on the rotary cover, so the fixing structure has to be replaced as the rotary cover is replaced for mechanical design of the notebook computer with different types, resulting in increase of manufacture cost. Thus, the conventional connector mechanism has importance issues of satisfying the height specification, low manufacture cost, enough assembly strength as well as keeping the aesthetic feeling of appearance.

SUMMARY OF THE INVENTION

The present invention provides a connector mechanism with a rotary cover driven by a resilient plate for fastening a plug, for solving above drawbacks.

According to the claimed invention, a connector mechanism includes a casing, a socket, a rotary cover and a resilient plate. An opening is formed on the casing. The resilient plate is connected to an inner side of the casing and the rotary cover for driving the rotary cover to rotate relative to the casing. The resilient plate includes a fixing portion fixed on the inner side of the casing, a driving portion resiliently connected to the fixing portion and the rotary cover for driving the rotary cover to rotate relative to the casing by deflection relative to the fixing portion, and a stopping portion disposed on the driving portion for stopping a tongue of a plug as the plug passes through the opening to connect with the socket, so as to fasten the plug.

According to the claimed invention, the connector mechanism further includes a fixing structure for fixing the fixing portion on the inner side of the casing.

According to the claimed invention, the fixing structure includes at least one positioning column passing through at least one hole on the fixing portion.

According to the claimed invention, the fixing structure includes at least one engaging portion for engaging a side of the fixing portion.

According to the claimed invention, the fixing structure includes at least one stopping wall for stopping a side of the fixing portion.

According to the claimed invention, the connector mechanism further includes a guiding structure for guiding the plug to connect with the socket as the plug passes through the opening.

According to the claimed invention, the guiding structure is disposed on the rotary cover or on the driving portion of the resilient plate.

According to the claimed invention, the guiding structure is made of conductive material for grounding as contacting with the plug.

According to the claimed invention, at least one slot is formed on the driving portion of the resilient plate, and the rotary cover includes at least one rib for wedging inside the at least one slot.

According to the claimed invention, the driving portion of the resilient plate is fixed on the rotary cover in a heat melt manner or by glue.

According to the claimed invention, the rotary cover includes at least one lift preventing member for engaging with the casing so as to prevent the rotary cover from lifting relative to the casing outwardly.

According to the claimed invention, a bending structure is formed on a side of the driving portion connected to the fixing portion.

According to the claimed invention, the resilient plate is made of metal material.

According to the claimed invention, the fixing portion, the driving portion and the stopping portion are formed integrally.

The present invention provides the connector mechanism with the rotary cover driven by the resilient plate for fastening the plug. The resilient plate drives the rotary cover to rotate by deflection deformation. The stopping portion for fastening the plug is disposed on the resilient plate, instead of being disposed on the rotary cover. Therefore, the fixing structure for fixing the plug does not have to be replaced as the rotary cover is replaced for mechanical design of the notebook computer with different types, so that manufacture cost is not increased. Thus, the connector mechanism of the present invention has advantages of satisfying the height specification, low manufacture cost, enough assembly strength as well as keeping the aesthetic feeling of appearance.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
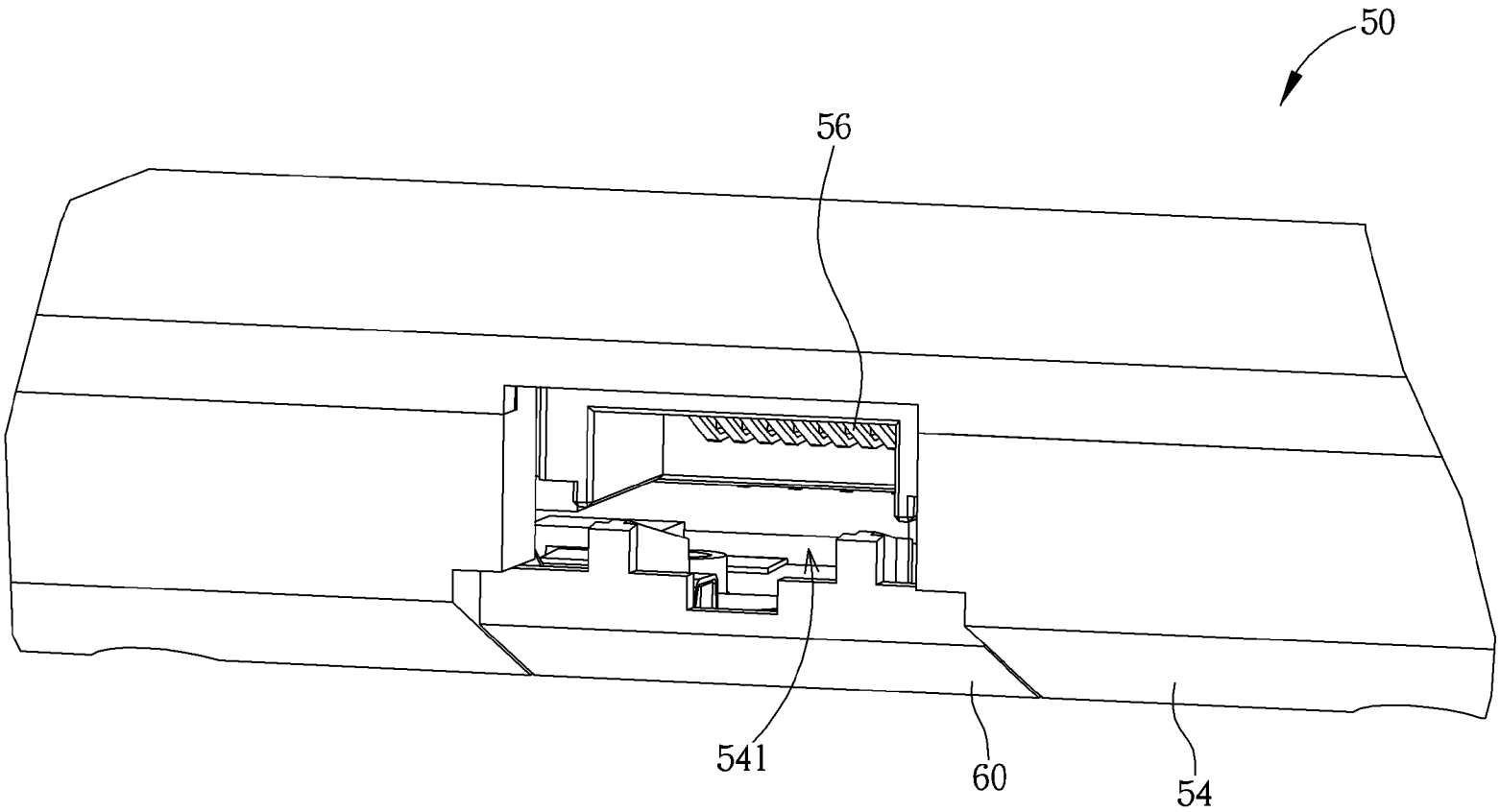
FIG. 1 is a schematic drawing of a connector mechanism according to an embodiment of the present invention.
Figure 2:
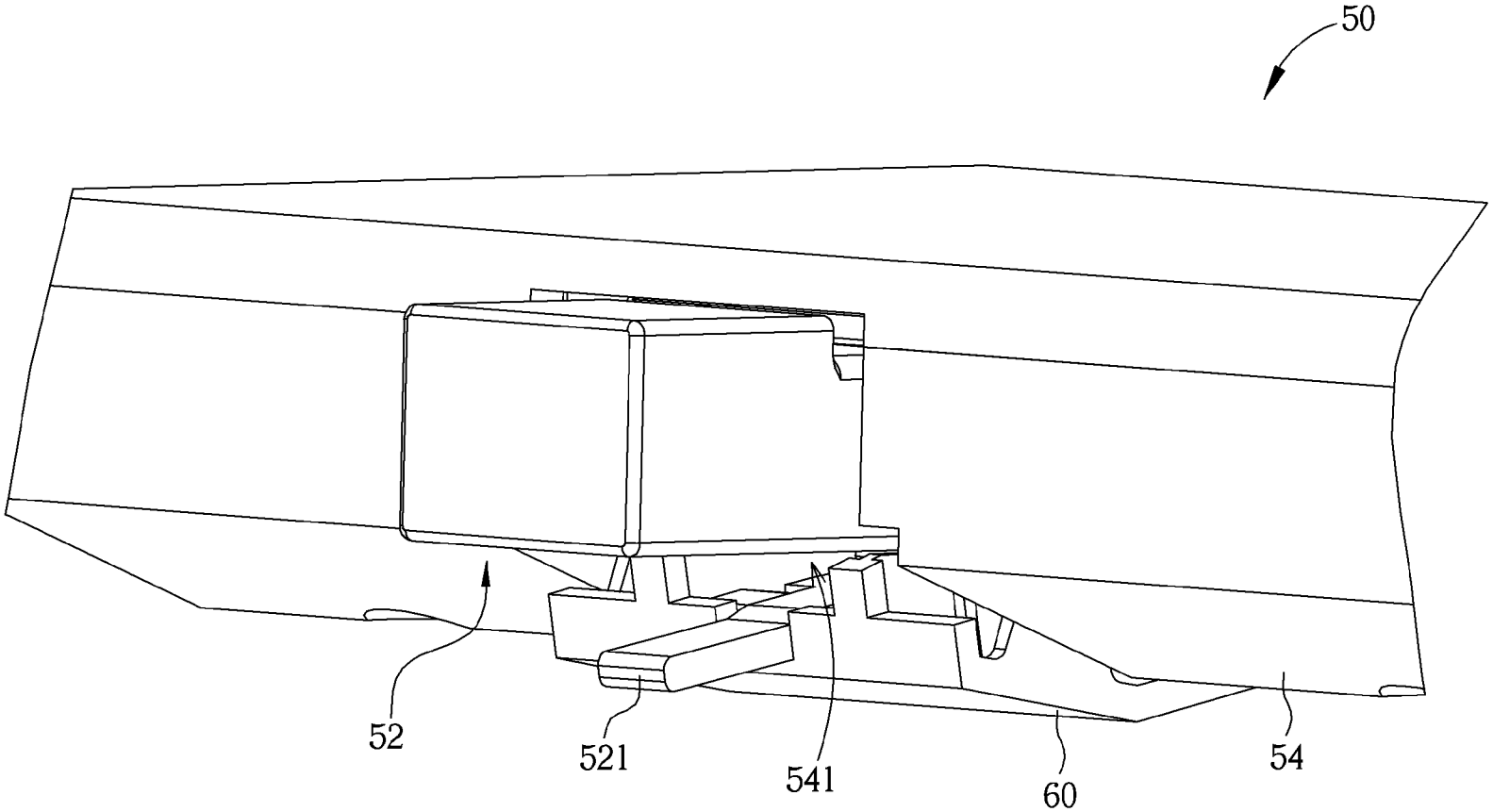
FIG. 2 is a schematic drawing of a plug inserting into the connector mechanism according to the embodiment of the present invention.
Figure 3:
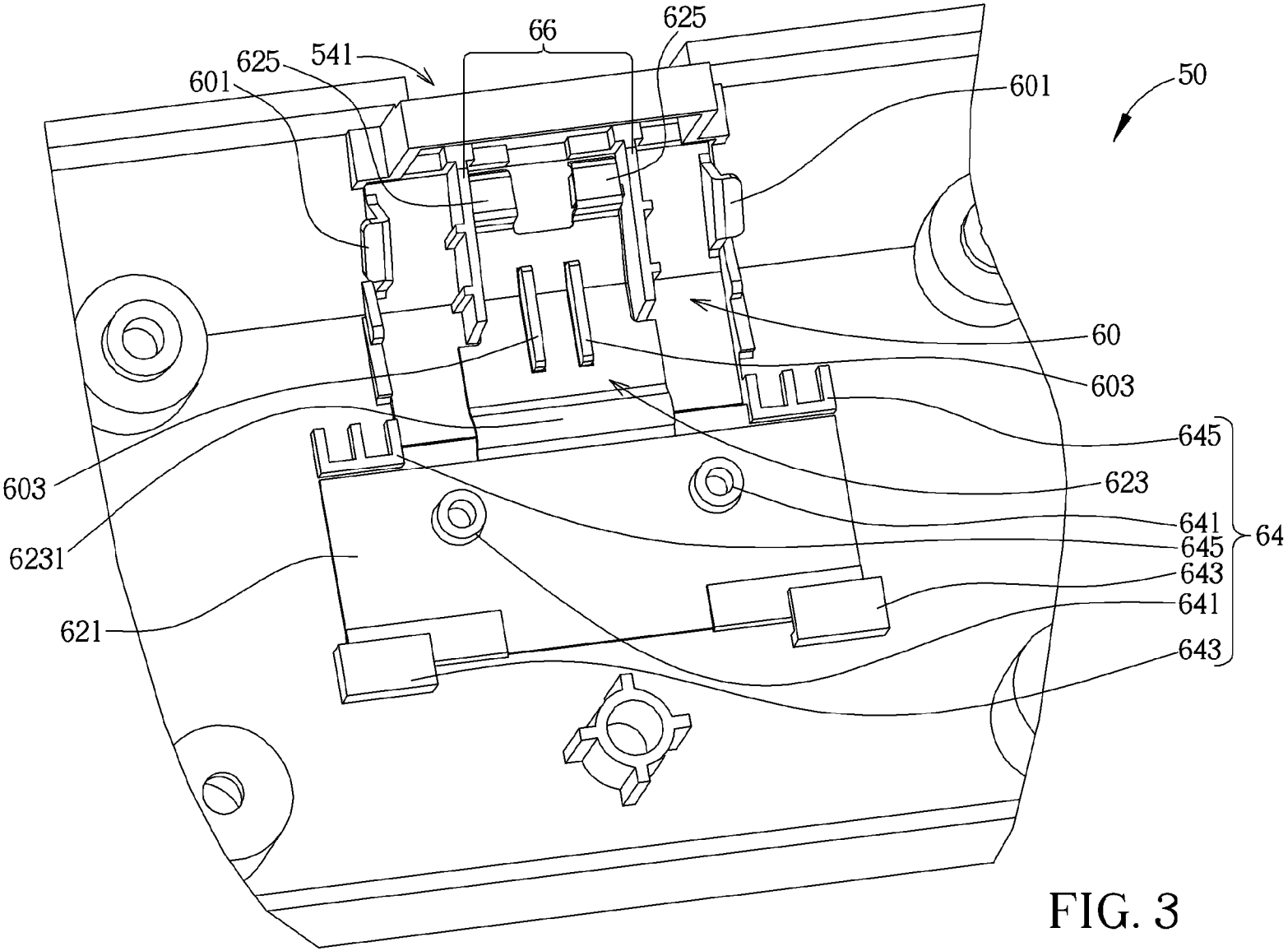
FIG. 3 is an internal structural diagram of the connector mechanism according to the embodiment of the present invention.
Figure 4:
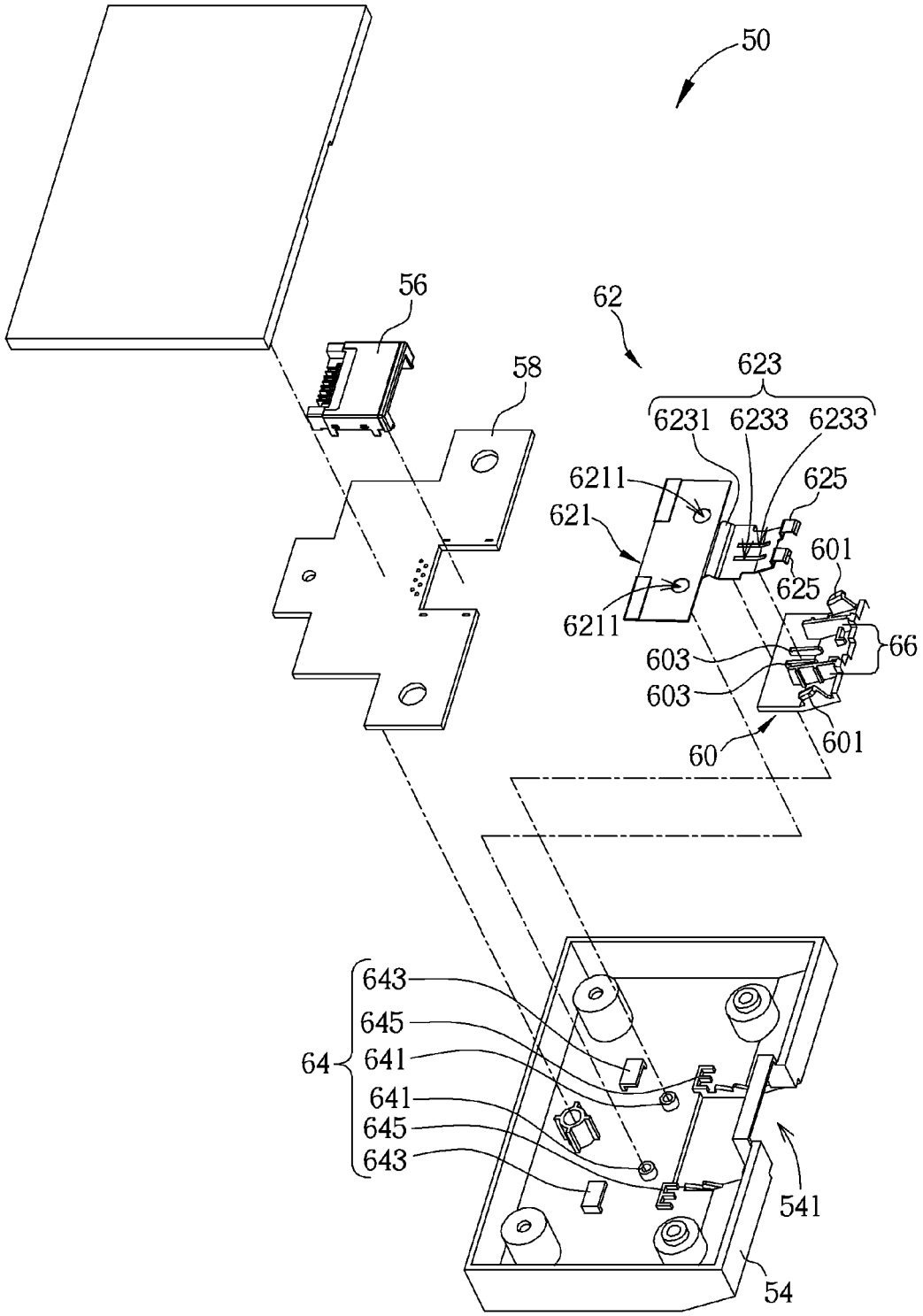
FIG. 4 is an exploded diagram of the connector mechanism according to the embodiment of the present invention.

Please refer to FIG. 1 to FIG. 4. FIG. 1 is a schematic drawing of a connector mechanism 50 according to an embodiment of the present invention. FIG. 2 is a schematic drawing of a plug 52 inserting into the connector mechanism 50 according to the embodiment of the present invention. FIG. 3 is an internal structural diagram of the connector mechanism 50 according to the embodiment of the present invention. FIG. 4 is an exploded diagram of the connector mechanism 50 according to the embodiment of the present invention. The connector mechanism 50 can be disposed on a lateral side of a notebook component. The connector mechanism 50 includes a casing 54 whereon an opening 541 is formed. The casing 54 can be an external housing of the notebook computer. The connector mechanism 50 further includes a socket 56 installed inside the casing 54 and disposed on a side of the opening 541. The socket 56 can be a half socket and installed on a circuit board 58. The socket 56 can be an Ethernet connecting port (such as a RJ45 connecting port), a cable modem connecting port (such as a RJ 11 connecting port) and so on. In other words, the connector mechanism 50 can be an Ethernet connector mechanism, a cable modem connector mechanism and so on, for connecting with the plug 52, such as an Ethernet contacting terminal (such as a RJ45 contacting terminal), a cable modem contacting terminal (such as a RJ 11 contacting terminal) and so on.

The connector mechanism further includes a rotary cover 60 connected to the casing 54 in a rotatable manner. The rotary cover 60 includes at least one lift preventing member 601 for engaging with the casing 54 when the rotary cover 60 rotates to a covering position as shown in FIG. 3, so as to prevent the rotary cover 60 from lifting relative to the casing 54 outwardly and to share pressing force generated by the plug 52 as the plug 52 is inserted into the opening 541 to connect with the socket 56. The lift preventing member 601 can be made of resilient material for overcoming structural interference with the casing 54 as engaging with or separating from the casing 54 by elastic deformation. The connector mechanism further includes a resilient plate 62 connected to an inner side of the casing 54 and the rotary cover 60 for driving the rotary cover 60 to rotate relative to the casing 54. The resilient plate 62 can be made of metal material. For example, the resilient plate 62 can be a copper plate spring. The resilient plate 62 includes a fixing portion 621, a driving portion 623 and a stopping portion 625. The fixing portion 621, the driving portion 623 and the stopping portion 625 can be formed integrally.

The fixing portion 621 of the resilient plate 62 is fixed on the inner side of the casing 54. The connector mechanism 50 can further include a fixing structure 64 for fixing the fixing portion 621 on the inner side of the casing 54. For example, the fixing structure 64 can selectively include at least one positioning column 641, at least one engaging portion 643 and at least one stopping wall 645. The at least one positioning column 641 passes through at least one hole 6211 on the fixing portion 621. In this embodiment, there are the two positioning columns 641 passing through the two holes 6211 on the fixing portion 621. The engaging portion 643 engages a side of the fixing portion 621. In this embodiment, there are the two engaging portions 643 respectively engaging two ends of the side of the fixing portion 621. The stopping wall 645 stops another side of the fixing portion 621. In this embodiment, there are the two stopping wall 645 respectively stopping two ends of the another side of the fixing portion 621, so as to assemble the fixing portion 621 on the inner side of the casing 54 precisely. Positions and amounts of components of the fixing structure 64 are not limited to those mentioned above and depend on practical design demand.

Furthermore, the driving portion 623 of the resilient plate 62 is resiliently connected to the fixing portion 621 and the rotary cover 60 for driving the rotary cover 60 to rotate relative to the casing 52 by deflection relative to the fixing portion 621. That is, the fixing portion 621 and the driving portion 623 can be respectively regarded as a fixing end and a free end of a cantilever. A bending structure 6231 is formed on a side of the driving portion 623 connected to the fixing portion 621 as a pivotal part of the driving portion 623 relative to the fixing portion 621. Besides, for fixing the resilient plate 62 and the rotary cover 60, at least one slot 6233 is formed on the driving portion 623 of the resilient plate 62, and the rotary cover 60 further includes at least one rib 603 for wedging inside the at least one slot 6233 on the driving portion 623, so as to prevent the resilient plate 62 from separating from the rotary cover 60. The driving portion 623 of the resilient plate 62 also can be fixed on the rotary cover 60 in a heat melt manner or by glue. The fixing mechanism of the resilient plate 62 and the rotary cover 60 is not limited to the above-mentioned one, and it depends on practical design demand.

The stopping portion 625 of the resilient plate 62 is disposed on the driving portion 623 for stopping a tongue 521 of the plug 52 as the plug 52 passes through the opening 541 to connect with the socket 56, so as to fasten the plug 52. For guiding the socket 56 into the connector mechanism 50 smoothly, the connector mechanism 50 can further include a guiding structure 66 for guiding the plug 52 to connect with the socket 56 as the plug 52 passes through the opening 541. The guiding structure 66 can be disposed on the rotary cover 60 or on the driving portion 623 of the resilient plate 62. For example, the guiding structure 66 can be composed of two ribs disposed on the rotary cover as shown in FIG. 3, so as to guide the plug 52 to insert into the opening 541 stably. Disposal and an amount of the guiding structure 66 are not limited to the above embodiment and depend on practical design demand. Furthermore, the guiding structure 66 can be made of conductive material for grounding as contacting with the plug 52.

Figure 5:
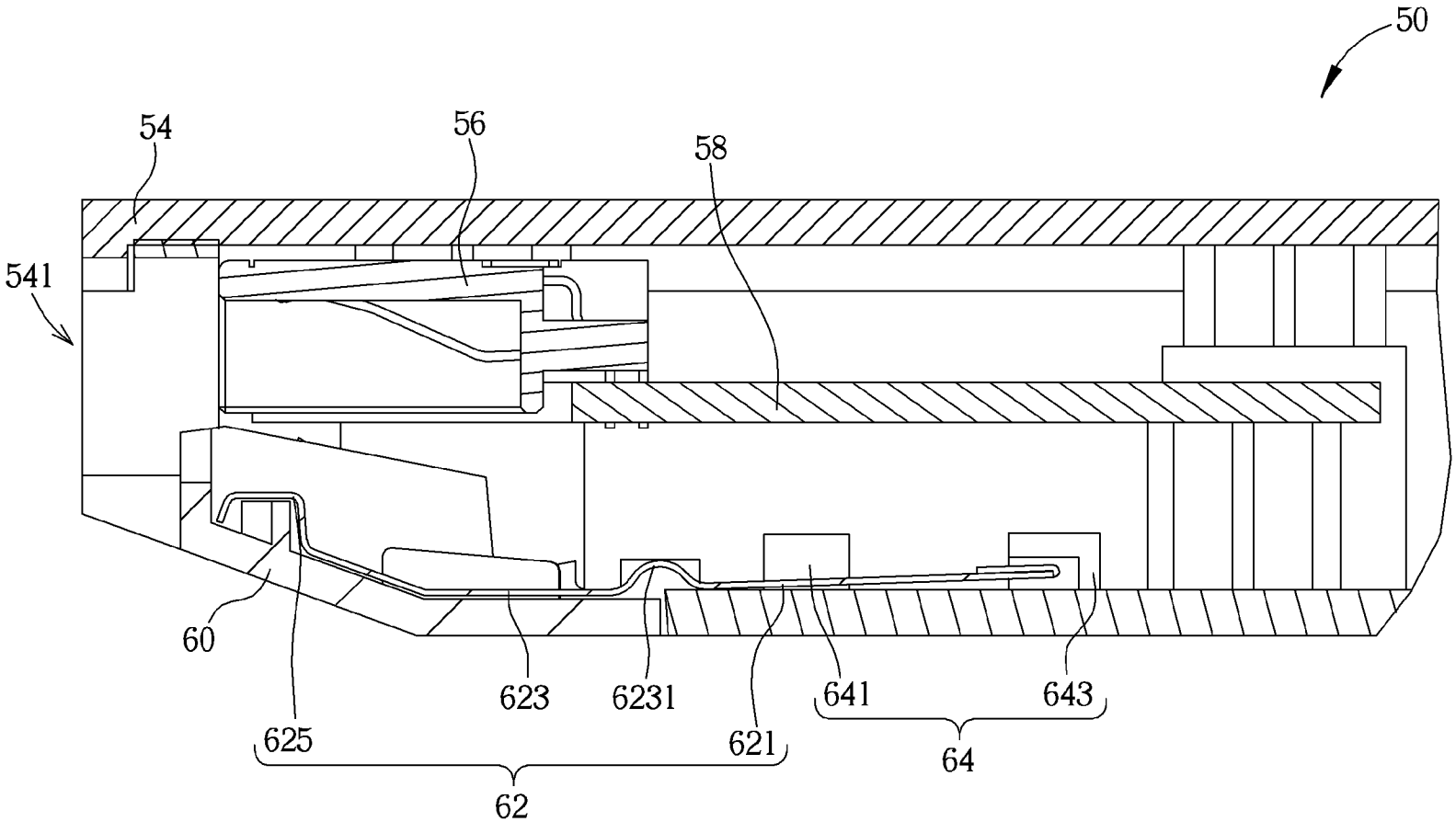
FIG. 5 to FIG. 7 are sectional diagrams of the connector mechanism in different statuses according to the embodiment of the present invention.
Figure 6:
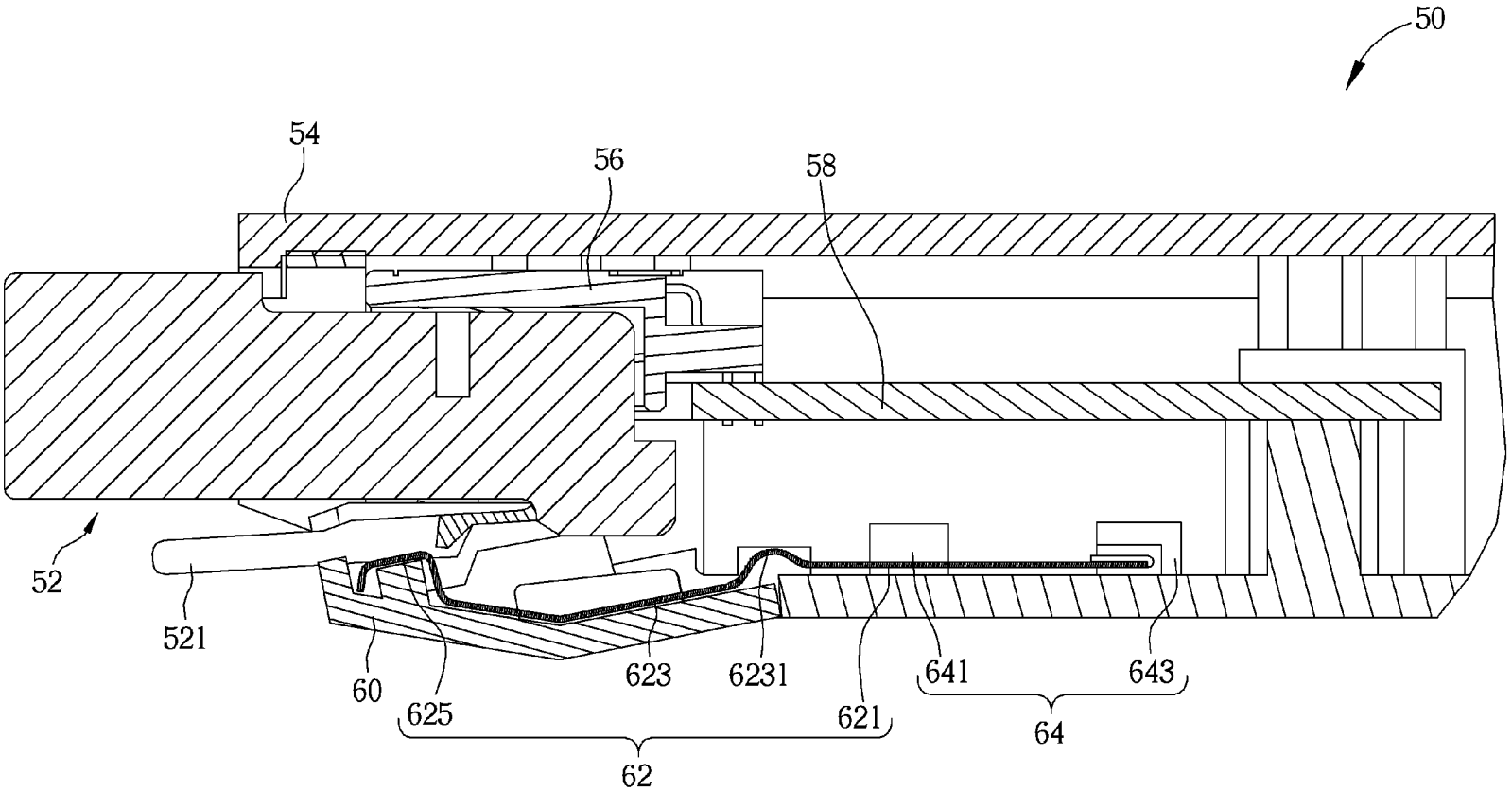
Figure 7:
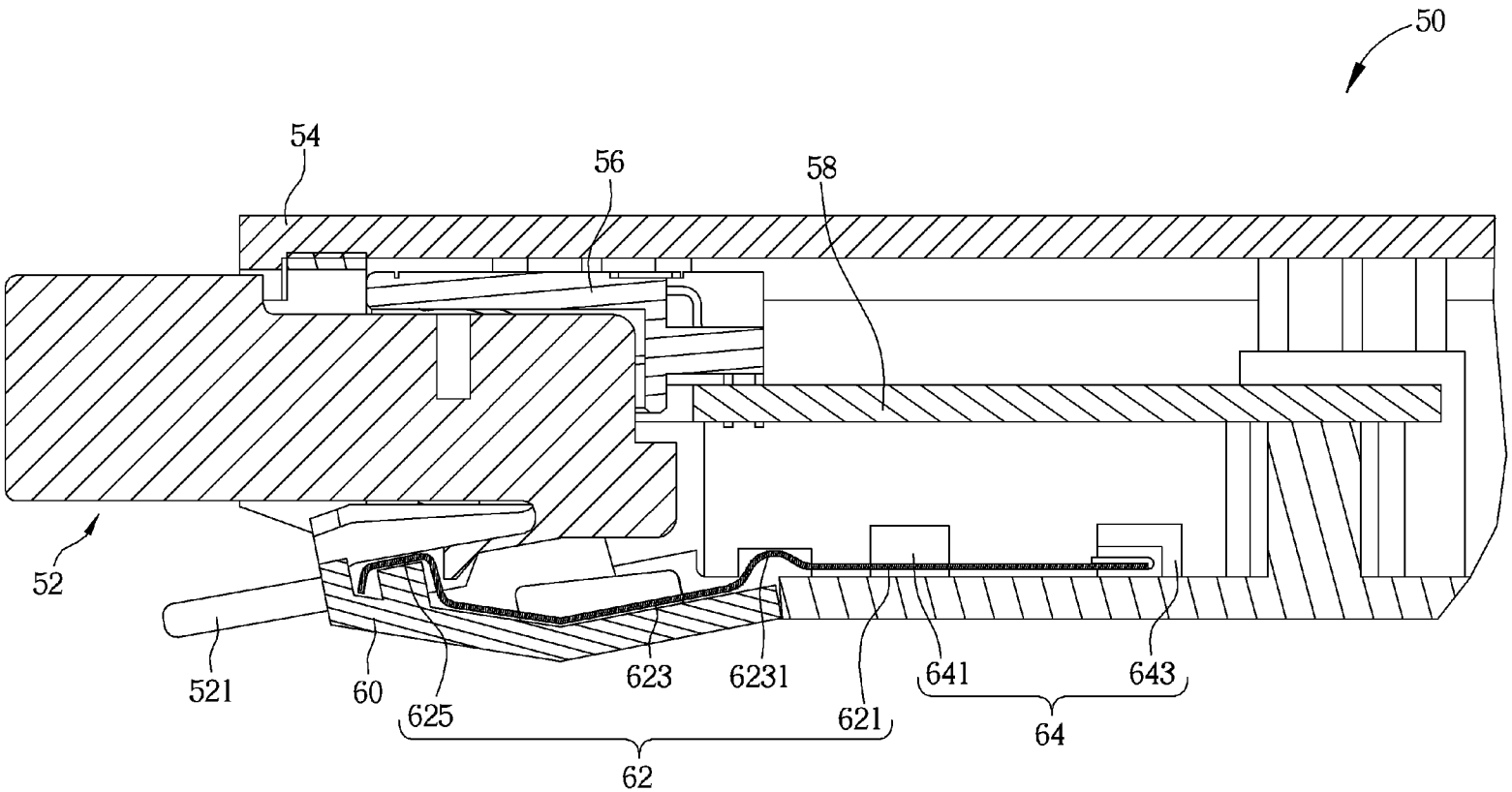

Please refer to FIG. 1 to FIG. 7. FIG. 5 to FIG. 7 are sectional diagrams of the connector mechanism 50 indifferent statuses according to the embodiment of the present invention. As shown in FIG. 1 and FIG. 5, when the plug 52 has not been inserted into the opening 541 on the casing 54, the driving portion 623 of the resilient plate 62 connected to the rotary cover 60 drives the rotary cover 60 to cover the opening partially, so as to protect internal components and provide a dustproof function. As shown in FIG. 6, when inserting the plug 52 into the opening 541 on the casing 54, the rotary cover 60 can be pressed down for rotating the rotary cover 60 relative to the casing 54 so as to provide space where the plug 52 is inserted into. Then a user can apply force to the tongue 521 of the plug 52 for inserting the plug 52 into the opening 541, and the guiding structure 66 can guide the plug 52 to connect with the socket 56. At this time, the plug 52 can drive the rotary cover 60 to rotate relative to the casing 54 in a counterclockwise direction as shown in FIG. 6, and the driving portion 623 of the resilient plate 62 connected to the rotary plate 60 is deformed by deflection.

Finally, as shown in FIG. 2 and FIG. 7, when the plug 52 has been inserted into the opening 541 on the casing 54 completely, that is, an end of the plug 52 is engaged with the socket 56, the tongue 521 of the plug 52 can be released. Accordingly, there is no structural interference between the rotary cover 60 and the plug 52, so that the driving portion 623 of the resilient plate 62 can provide resilient recovering force to the rotary cover 60 for driving the stopping portion 625 of the resilient plate 62 to stop the tongue 521 of the plug 52, so as to fasten the plug 52 in the connector mechanism 50 stably. On the other hand, for disassembling the plug 52 from the connector mechanism 50, the user has to apply force to the tongue 521 of the plug 52 for separating the tongue 521 from the stopping portion 625 and then to draw out the plug 52 outwardly. At this time, the plug 52 drives the rotary cover 60 to rotate relative to the casing 54 again so that the plug 52 can be drawn out easily. After the plug 52 separates from the opening 541, the driving portion 623 of the resilient plate 62 can provide resilient recovering force to drive the rotary cover 60 back to the position as shown in FIG. 1 and FIG. 5, so as to protect internal components and provide the dustproof function.

In contrast to the prior art, the present invention provides the connector mechanism with the rotary cover driven by the resilient plate for fastening the plug. The resilient plate drives the rotary cover to rotate by deflection deformation. The stopping portion for fastening the plug is disposed on the resilient plate, instead of being disposed on the rotary cover. Therefore, the fixing structure for fixing the plug does not have to be replaced as the rotary cover is replaced for mechanical design of the notebook computer with different types, so that manufacture cost is not increased. Thus, the connector mechanism of the present invention has advantages of satisfying the height specification, low manufacture cost, enough assembly strength as well as keeping the aesthetic feeling of appearance.

Those skilled in the art will readily observe that numerous modifications and alterations of the device and method may be made while retaining the teachings of the invention.

What is claimed is:

1. A connector mechanism comprising:

a casing whereon an opening is formed;

a socket installed inside the casing and disposed on a side of the opening;

a rotary cover connected to the casing in a rotatable manner; and a resilient plate connected to an inner side of the casing and the rotary cover for driving the rotary cover to rotate relative to the casing, the resilient plate comprising:

a fixing portion fixed on the inner side of the casing;

a driving portion resiliently connected to the fixing portion and the rotary cover for driving the rotary cover to rotate relative to the casing by deflection relative to the fixing portion; and a stopping portion disposed on the driving portion for stopping a tongue of a plug as the plug passes through the opening to connect with the socket, so as to fasten the plug.

2. The connector mechanism of claim 1, further comprising a fixing structure for fixing the fixing portion on the inner side of the casing.

3. The connector mechanism of claim 2, wherein the fixing structure comprises at least one positioning column passing through at least one hole on the fixing portion.

4. The connector mechanism of claim 2, wherein the fixing structure comprises at least one engaging portion for engaging a side of the fixing portion.

5. The connector mechanism of claim 2, wherein the fixing structure comprises at least one stopping wall for stopping a side of the fixing portion.

6. The connector mechanism of claim 1, further comprising a guiding structure for guiding the plug to connect with the socket as the plug passes through the opening.

7. The connector mechanism of claim 6, wherein the guiding structure is disposed on the rotary cover or on the driving portion of the resilient plate.

8. The connector mechanism of claim 6, wherein the guiding structure is made of conductive material for grounding as contacting with the plug.

9. The connector mechanism of claim 1, wherein at least one slot is formed on the driving portion of the resilient plate, and the rotary cover comprises at least one rib for wedging inside the at least one slot.

10. The connector mechanism of claim 1, wherein the driving portion of the resilient plate is fixed on the rotary cover in a heat melt manner or by glue.

11. The connector mechanism of claim 1, wherein the rotary cover comprises at least one lift preventing member for engaging with the casing so as to prevent the rotary cover from lifting relative to the casing outwardly.

12. The connector mechanism of claim 1, wherein a bending structure is formed on a side of the driving portion connected to the fixing portion.

13. The connector mechanism of claim 1, wherein the resilient plate is made of metal material.

14. The connector mechanism of claim 1, wherein the fixing portion, the driving portion and the stopping portion are formed integrally.

* * * * *